United States Patent [19]

McGlothen et al.

[11] Patent Number: 4,637,460

[45] Date of Patent: Jan. 20, 1987

[54] PARALLEL FLOW TUBE APPARATUS

[75] Inventors: Jody R. McGlothen, Garland, Tex.; Damon P. Little, Bakersfield, Calif.

[73] Assignee: Dresser Industries, Inc., Dallas, Tex.

[21] Appl. No.: 714,588

[22] Filed: Mar. 21, 1985

[51] Int. Cl.[4] ..... E21B 33/122

[52] U.S. Cl. ..... 166/189; 166/191; 166/313

[58] Field of Search ..... 166/189, 191, 196, 97.5, 166/313, 380, 382, 387, 192

[56] References Cited

U.S. PATENT DOCUMENTS

| | | | |
|---|---|---|---|
| 2,903,066 | 9/1959 | Brown | 166/313 |
| 3,170,518 | 2/1965 | Brown | 166/313 |
| 3,198,254 | 8/1965 | Wise et al. | 166/387 X |
| 3,335,800 | 8/1967 | Myers | 166/189 X |
| 3,357,489 | 12/1967 | Brown | 166/189 X |
| 3,934,648 | 1/1976 | Amancharla et al. | 166/189 X |
| 4,305,465 | 12/1981 | Ellis | 166/382 |
| 4,374,543 | 2/1983 | Richardson | 166/192 |

*Primary Examiner*—Stephen J. Novosad
*Assistant Examiner*—David J. Bagnell

[57] ABSTRACT

A parallel flow tube assembly for producing or treating formations in a well bore wherein the formations are isolated by upper and lower spaced packers. The parallel flow tube assembly includes a coupling member having parallel bores therein. A seal sleeve extends downwardly therefrom for sealingly engaging the interior of the upper packer. A tube extends downwardly through and in sealing engagement with the lower packer and said coupling member is connected to a primary tubing string that is in fluid communication with the formation below the lower packer and a secondary tubing string that is connected in communication with the formation located between the packers.

8 Claims, 5 Drawing Figures

PARALLEL FLOW TUBE APPARATUS

BACKGROUND OF THE INVENTION

This invention relates generally to improved apparatus for use in treating or producing multiple zones in well bores. More particularly, but not by way of limitation, this invention relates to an improved parallel flow tube apparatus for use in connection with treating and producing upper and lower zones in a well bore having a lower packer set between and isolating one zone from the other and an upper packer set above the upper zone isolating the upper zone from the well bore above the zone.

Parallel flow tube apparatus, as constructed in the past, has worked satisfactorily. However, such apparatus has been constructed in a manner that produced a parallel flow tube member that was extremely heavy, because it was generally produced from essentially one piece of material. The size, weight, and manufacturing technique has resulted in an extremely expensive apparatus.

An object of this invention is to provide an improved parallel flow tube apparatus that is of substantially lighter weight, substantially less expensive, functions at least as well as the prior apparatus, and eliminates the waste resulting from the production of the prior apparatus.

SUMMARY OF THE INVENTION

This invention then provides an improved parallel flow tube apparatus for use in connection with treating and producing upper and lower zones in a well bore having a lower packer set between and isolating one zone from the other and an upper packer set above the upper zone isolating the upper zone from the well bore above the zone. The apparatus comprises: a coupling member having first and second generally parallel bores extending therethrough; a first tubing member connected in the first bore and extending upwardly therefrom; a second tubing member connected in the first bore and extending downwardly therefrom and arranged to extend through the lower packer; a seal sleeve attached to the coupling member and encircling the second tubing member, the seal sleeve having seals on the exterior thereof arranged to extend through and to sealingly engage the upper packer and having a latch thereon for connecting the seal sleeve to the upper packer; and a third tubing member connected to the coupling member in the second bore and extending upwardly therefrom.

BRIEF DESCRIPTION OF THE DRAWING

The foregoing and additional objects and advantages of the invention will become more apparent as the following detailed description is read in conjunction with the accompanying drawing wherein like reference characters denote like parts in all views and wherein.

DETAILED DESCRIPTION OF THE PREFERRED EMBODIMENT

Figure 1:
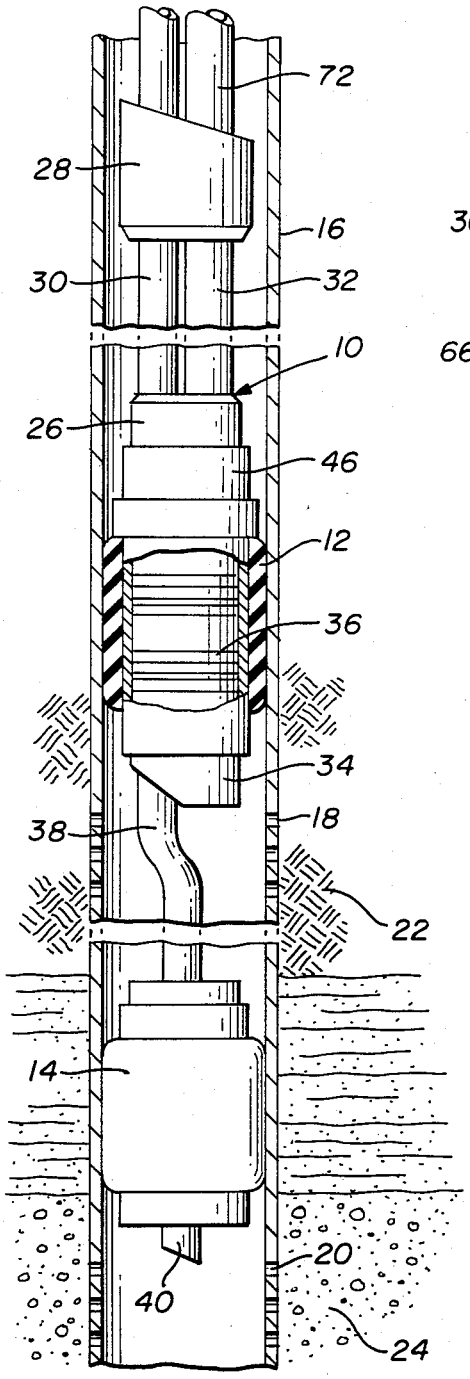
FIG. 1 is a view of apparatus constructed in accordance with the invention located in a well bore and shown partly in elevation and partly in cross section.

Referring to the drawing, and to FIG. 1 in particular, shown therein and generally designated by the reference character 10, is parallel flow tube assembly that is constructed in accordance with the invention. The parallel flow tube assembly is illustrated as being connected to an upper packer 12 and disposed in a lower packer 14. The parallel flow tube apparatus 10, the upper packer 12 and the lower packer 14 are located in a cased well bore 16 that includes a plurality of upper perforations 18 and lower perforations 20. It should be noted that the arrangement of the packers 12 and 14 is such that the upper perforations 18 are disposed adjacent to a formation 22 that is isolated from the remainder of the well bore by the upper packer 12. Also, the formation 22 is isolated from a lower formation 24, which is located adjacent to the perforations 20, by the lower packer 14. The formations 22 and 24 may either be producing hydrocarbons or being subjected to treatment through the perforations 18 and 20, either simultaneously or on a selective basis. It will, of course, be understood that the packers 12 and 14 will include the usual slips and other equipment necessary for maintaining their position in the cased well bore 16. Such items have been eliminated in the interest of simplifying the illustration of FIG. 1.

The parallel flow tube assembly 10 includes a coupling member 26 that is connected to a generally cylindrical scoop member 28 by a primary tube 30 and a secondary extension tube 32. The coupling member 26 has a sealing sleeve 34 threadedly attached thereto that extends downwardly through the upper packer 12.

The sealing sleeve 34 carries on its exterior a plurality of annular seal members 36 that are in sealing engagement with the interior of the packer 12 when the sleeve 34 is disposed therein.

An extension 38 of the primary tube 30 extends downwardly from the coupling 26 through the seal sleeve 34 and through the lower packer 14. A lower end 40 of the extension 38 can be seen projecting below the lower packer 14. Although not shown, it will be understood that the extension 38, where it passes through the lower packer 14, will carry appropriate seals so that fluid cannot migrate between the formations 22 and 24 between the extension 38 and the interior of the lower packer 14.

Turning from the somewhat schematic view of FIG. 1, the details of construction of the parallel flow tube assembly 10 is shown more clearly in FIGS. 2A and 2B, FIG. 3 and FIG. 4.

As shown therein, the coupling 26 includes generally parallel bores 42 and 44. The bore 42 threadedly receives the primary tube 30 and also threadedly receives the extension 38 thereof. The bore 44 threadedly receives the lower end of the secondary extension tube 32.

On its exterior, the coupling member 26 is provided with an annular spacer member 46 that projects downwardly to engage the upper end of the packer 12 (see FIG. 1) to limit the distance that the seal sleeve 34 can enter the bore of the upper packer 12. The upper end 48 of the sleeve 34 is threadedly connected to the coupling member 26. The lower end 50 of the seal sleeve 34 is tapered as illustrated at 52 to ease its entrance into the bore of the upper packer 12.

Intermediate the ends 48 and 50 of the sleeve 34, there is provided a plurality of circumferentially spaced and radially projecting lugs 54. Just below the lugs 54, there is provided a radially projecting annular shoulder 56. The purpose of the lugs 54 and the shoulder 56 will become more apparent hereinafter.

To latch the parallel flow tube assembly 10 into the upper packer 12, there is provided a latch member 58 which includes an annular portion 60 that loosely encircles the sleeve 34 adjacent to the upper end 48 thereof. A plurality of latch tines 62 project downwardly from the annular portion 60 in circumferentially spaced relation about the seal sleeve 34. The latch member 58 is slidable in the vertical direction relative to the seal sleeve 34. Rotation of the latch member 58 is prevented since the lugs 54 project between the tines 62. Each of the tines is provided with a plurality of teeth 64 that are engageable with the threaded interior portion (not shown) of the upper packer 12.

Figure 2A:
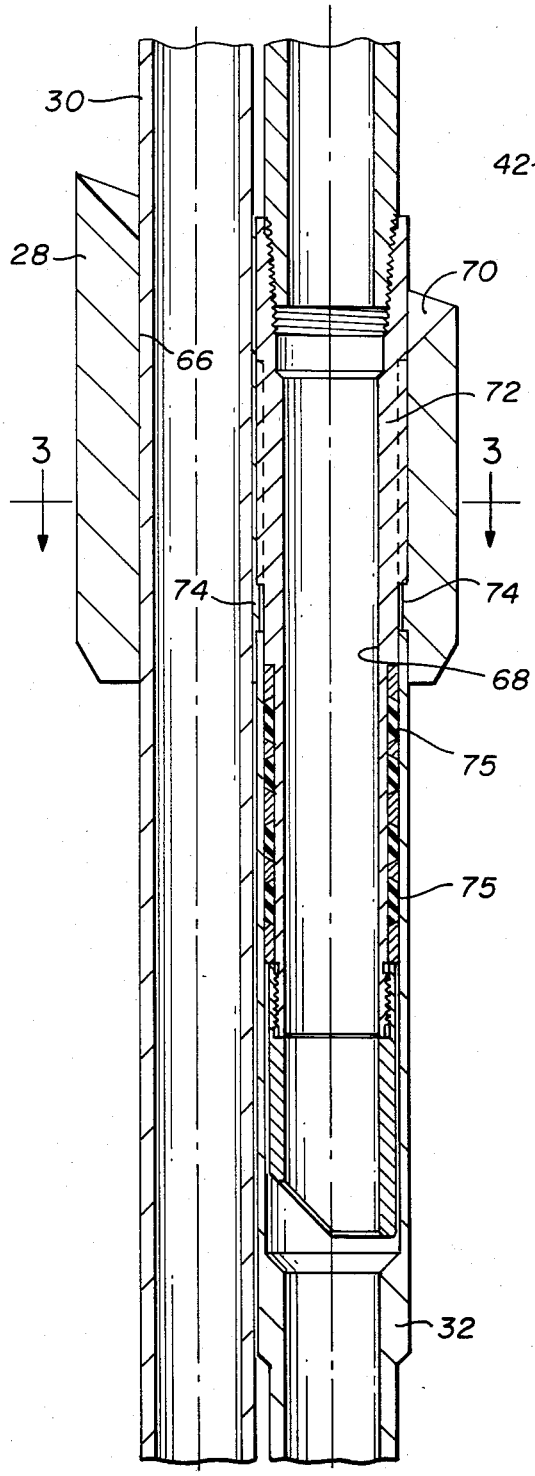
FIGS. 2A and 2B comprise an enlarged fragmentary cross section of parallel flow tube apparatus that is constructed in accordance with the invention.
Figure 2B:
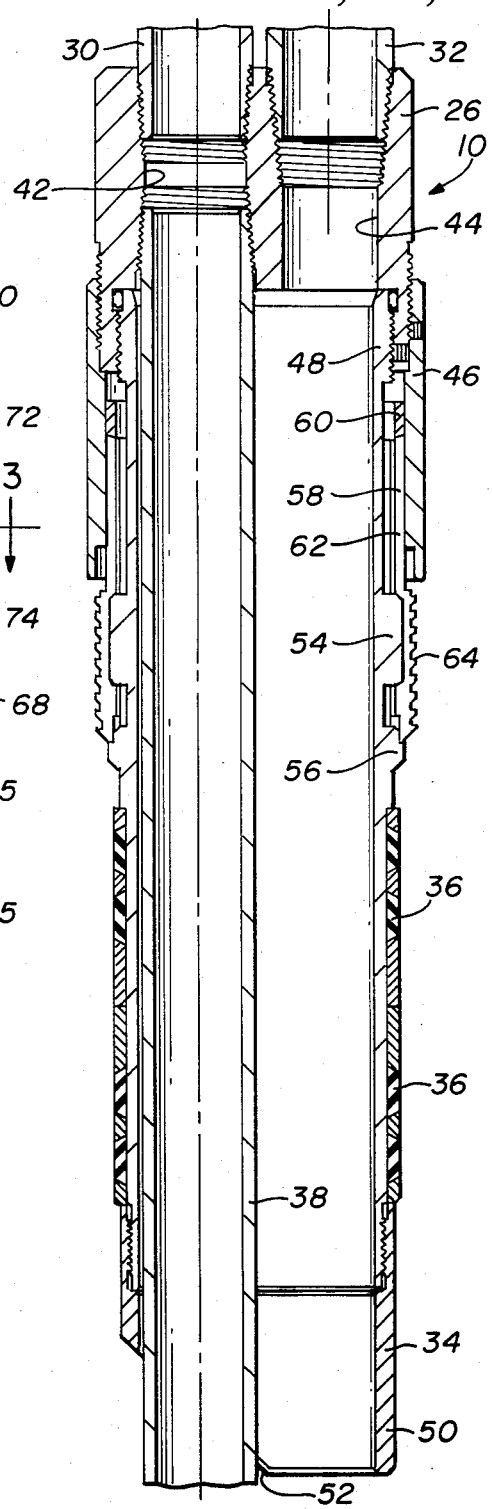

Referring to FIG. 2A, it can be seen that the primary tube 30 extends upwardly through a bore 66 in the scoop member 28. The secondary extension tube 32 is connected to the scoop member 28 in a second bore 68 that extends generally parallel through the scoop member 28 relative to the bore 66. It will be noted that the secondary extension tube 32 is secured to the scoop member 28 relatively near the bottom thereof.

An upper surface 70 on the scoop member 28 has a concave configuration to direct a secondary tube 72 into connection with the secondary extension tube 32 during the use of apparatus.

The scoop member 28 is also provided with a pair of diametrically opposed gudgeon pins 74 that project into the bore 68 and into a pair of J slots 76 (see FIG. 4) to latch the lower end of the secondary tube 72 to the scoop member 28. Also, it will be noted that the lower end of the secondary tube 72 is provided with a plurality of annular seals 75 that are arranged to sealingly engage the interior of the secondary extension tube 32 when the lower end of the tube 72 is disposed therein as illustrated in FIG. 2A.

Figure 3:
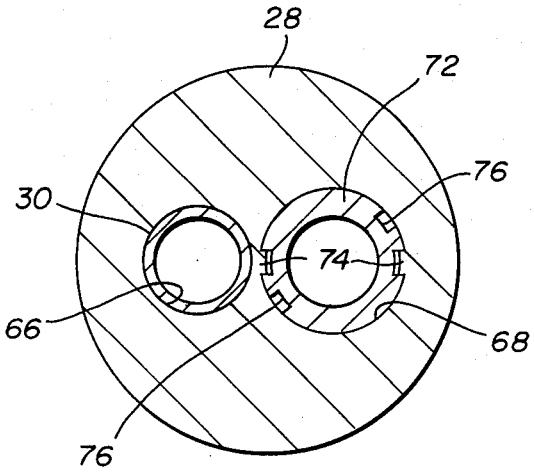
FIG. 3 is a horizontal cross section taken generally along the line 3—3 of FIG. 2A.

The cross-sectional view of FIG. 3 illustrates the disposition of the gudgeon pins 74 in the J-slots 76 in the lower end of the extension 72. That figure also clearly illustrates the relationship between the bores 66 and 68 in the scoop member 28.

Figure 4:
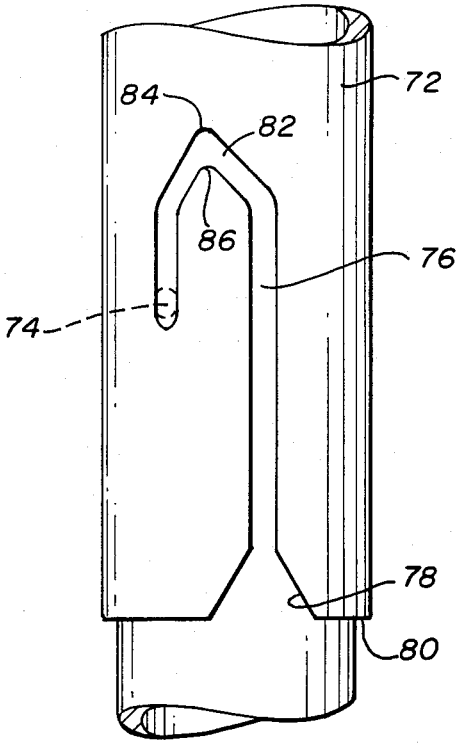
FIG. 4 is an enlarged, fragmentary elevation of a portion of the flow tube apparatus.

FIG. 4 illustrates in more detail the structure of one of the J slots 76 on the tube 72. As illustrated therein, the J slot 76 extends generally downwardly, widening at 78 where it extends through a downwardly facing shoulder 80 on the tube 72 to provide a guided entrance for the gudgeon pin 74. The J-slot extends upwardly to a generally V-shaped portion 82 which forms the bottom of the J. Note that the apex 84 of the V-shaped portion 82 is offset from the inner apex 86 of the V-shaped portion 82 so that when the gudgeon pin 74 reaches this position an upward strain on the tube 72, automatically moves the pin 74 to the position illustrated by the dash line.

OPERATION OF THE PREFERRED EMBODIMENT

To utilize the parallel flow tube assembly 10, the lower packer 14 is lowered into and positioned in the cased well bore 16 at the desired location between the formations 22 and 24 and between the perforations 18 and 20. The upper packer 12 is then run into and set in the well bore 16 above the upper perforations 18 and formation 22. The parallel flow tube assembly 10 is assembled on the lower end of the tubing string 30 with the scoop member 28 located above the coupling 26 a distance dictated by the length of the secondary extension tube 32 which extends therebetween.

The primary string 30, with the attached parallel flow tube assembly 10, is lowered into the bore 16. Upon reaching the upper packer 12, the sleeve 34 is introduced into the bore of that packer with the seals 36 carried on the sleeve member 34 engaging and forming a fluid-tight seal with the packer 12.

As previously mentioned, the sleeve 34 can be lowered into the packer 12 only to the distance dictated by the length of the spacer 46. As the sleeve 34 is lowered into the packer 12, the teeth 64 engage the threads (not shown) in the packer 12, moving the latch member 58 upwardly until the lower ends of the tines 62 clear the annular shoulder 56. When this occurs, the tines 62 flex inwardly and the teeth 64 ratchet downwardly past the threads in the packer 12. Upon reaching the lowermost position, an upward strain taken on the tubing string 30 pulls the shoulder 56 upwardly underneath the ends of the tines 62, holding the teeth 64 in latching engagement with the threads (not shown) in the packer 12.

As will be appreciated, the lowering of the sleeve 34 through the packer 12 also introduces the tubing extension 38 into the bore of the lower packer 14. The lower packer 14 is provided with a lander (not shown), which serves to guide the tube 38 into the proper location and may be appropriately provided with seals (not shown) which will seal on the tube 38.

The secondary tube 72 is then lowered into the casing 16 until the lower end thereof enters the bore 68 in the scoop member 28. As the tube 72 is moved downwardly in the bore 68, the J-slots 76 slide over the gudgeon pins 74 until the apexes 84 of the slots 76 reach the gudgeon pins 74. When this occurs, downward movement of the extension 72 is arrested. An upward strain on the secondary tube 72 causes the J-slots 76 to move upwardly until the pins 74 are positioned as shown in the dash line of FIG. 4.

At this point, the apparatus is in condition to either treat the well by, for example, pumping steam down the tubes 30 and 72, or by producing oil or gas from the formations 22 and 24 through the perforations 18 and 20. It will, of course, be apparent that any fluid produced or directed toward the formation 24 and flowing through the perforations 20 will flow upwardly through the lower end 40 of the extension 38 and to the surface through the primary string 30. Fluid produced by the formation 22 through the perforations 18 will flow upwardly through the interior of the sleeve 34, entering the lower end of the secondary extension tube 32 and passing to the surface through the secondary tube 72.

When it is desired to remove the assembly 10 from the bore 16, it is first necessary to remove the secondary tube 72 from the secondary extension tube 32. This is accomplished by lowering the tube 72 and rotating the tube 72 to move the J-slots relative to the pins 74 until the J-slots in the tube 72 can be lifted off of the gudgeon pins 74. The tube 72 may then be removed from the well bore 16.

To unlock the seal sleeve 34 from the upper packer 12, it is necesary to rotate the primary string 30 and the parallel flow tube assembly 10. Such rotation unscrews the tines 62 from the threads (not shown) in the upper packer 12 so that the entire assembly can then be raised from the well bore.

From the foregoing, it will be appreciated that the parallel flow tube assembly described in detail hereinbefore will permit either treatment of a pair of spaced formations in the well or the production of hydrocarbons therefrom. It will be apparent that the particular structural arrangement of the parallel flow tube assembly 10 admits of a relatively easy manufacturing procedures, and will be of relatively light weight, and less expensive than any previously known flow tube assemblies.

It will also be understood that the foregoing detailed description is presented by way of example only, and that many changes and modifications can be made thereto without departing from the spirit and scope of the annexed claims.

What is claimed is:

1. Improved parallel flow tube apparatus for use in connection with treating and producing of upper and lower zones in a well bore having a lower packer set between and isolating one zone from the other and an upper packer set above said upper zone isolating said upper zone from the well bore above said zone, said apparatus comprising:

a coupling member having first and second generally parallel bores extending therethrough;

a first tubing member connected in said first bore and extending upwardly therefrom;

a second tubing member connected in said first bore and extending downwardly therefrom and arranged to extend through the upper and lower packers;

a seal sleeve is sealingly attached at its upper end to said coupling member, said sleeve having a diameter sized to encircle said second tubing member and encompass a downward projection of said second bore, said seal sleeve having seal means on the exterior thereof arranged to extend through and to sealingly engage the upper packer and having latch means thereon for connecting said seal sleeve to the upper packer; and, a third tubing member connected to said coupling member in said second bore and extending upwardly therefrom.

2. The apparatus of claim 1 and also including a generally cylindrical scoop member having first and second generally parallel bores extending therethrough, said first bore encircling said first tubing member and said second bore being connected with an upper end portion of said third tubing member.

3. The apparatus of claim 2 wherein:

the second bore in said scoop member has a pair of gudgeon pins projecting into said second bore; and said apparatus also includes a fourth tubing member that extends through the second bore in said scoop member into said third tubing member, said fourth tubing member including a pair of J-slots on the exterior thereof for receiving said gudgeon pins to latch said fourth tubing member to said scoop member and having seal means thereon disposed within and in sealing engagement with said third tubing member.

4. An improved parallel flow tube comprising:

a coupling member having first and second generally parallel bores extending therethrough, each said bore being arranged to receive and connect a tubing member from one end and one said bore being arranged to receive and connect a tubing member from the other end of said coupling member;

an elongated seal sleeve having a first end sealingly connected to said other end of said coupling member and extending therefrom terminating in a second end, said sleeve having a diameter sized to encompass both said bores; and annular seal means encircling said sleeve between said first and second ends for forming a fluid-tight seal between said seal sleeve and a cylindrical member in which said sleeve may be disposed.

5. The flow tube of claim 4 and also including latch means carried by said sleeve for releasably connecting said sleeve to the cylindrical member.

6. The flow tube of claim 5 wherein said latch means includes a latch member comprising:

an annular portion slidably encircling said sleeve; and, a plurality of depending latch tines biased outwardly relative to said sleeve for engaging the cylindrical member.

7. The flow tube of claim 6 wherein:

said latch member includes a surface on said other end for engaging said annular portion to limit the movement thereof on said sleeve;

said sleeve includes a plurality of lugs radially projecting between said tines to limit the rotational movement of said latch member on said sleeve, and, said sleeve also includes an annular flange for engaging said tines to prevent inward movement thereof when said tines are in engagement with the cylindrical member.

8. The flow tube of claim 7 and also including an annular member connected to said coupling member generally concentrically with said sleeve and overlying a portion of said latch member for engaging the cylindrical member to limit the movement of said sleeve into the cylindrical member.

* * * * *